United States Patent [19]

Röck et al.

[11] 4,385,417

[45] May 31, 1983

[54] QUADRILATERAL OVER CENTER HINGE

[76] Inventors: Erich Röck, Küferstr. 7, Höchst, Austria, A-6973; Klaus Brüstle, Fellentorstr. 23, Lauterach, Austria, A-6923

[21] Appl. No.: 270,122

[22] Filed: Jun. 3, 1981

[30] Foreign Application Priority Data

Jun. 12, 1980 [AT] Austria ..... A 3094/80

[51] Int. Cl.[3] ..... E05D 15/32; E05D 3/06; E05F 1/12

[52] U.S. Cl. ..... 16/288

[58] Field of Search ..... 16/288, 292, 287, 289, 16/290, 291, 297, 333

[56] References Cited

U.S. PATENT DOCUMENTS

| | | | |
|---|---|---|---|
| 3,363,281 | 1/1968 | Borsani | 16/288 |
| 3,952,368 | 4/1976 | Zernig et al. | 16/291 |
| 4,123,823 | 11/1978 | Lautenschlager | 16/288 |
| 4,166,307 | 9/1979 | Rock et al. | 16/288 |

*Primary Examiner*—Werner H. Schroeder
*Assistant Examiner*—Andrew M. Falik
*Attorney, Agent, or Firm*—Wenderoth, Lind & Ponack

[57] ABSTRACT

A hinge comprises a closing member which is acted upon by a spring, the spring being arranged in a shell and one end thereof resting against a hinge axle. The shell has a lateral driving pin which rests against a supporting flange associated with a hinge link, the supporting flange having a curved guiding surface for generating a closing pressure. The supporting flange is formed on a separate guiding block mountable on the hinge link.

7 Claims, 5 Drawing Figures

QUADRILATERAL OVER CENTER HINGE

BACKGROUND OF THE INVENTION

1. Field of the Invention

The present invention relates to a hinge in which a hinge arm fastened to a furniture side wall is by means of two hinge links connected with a hinge casing or the like fastened to a door of the piece of furniture, one of the hinge links being acted upon by a pressure spring pressing on such one hinge link by means of an intermediate member arranged between such one hinge link and the pressure spring, the intermediate member being a shell in which the pressure spring is situated.

2. Description of the Prior Art

Such hinges are widely used in modern furniture construction, particularly in the construction of modern kitchen furniture. A closing mechanism in the hinge frequently replaces a separate closing means on the door, e.g. catch means, and thereby lowers the cost of such articles of furniture. The closing mechanism further prevents the door from remaining open unintentionally, when the door has not been fully closed, as such mechanism pulls the door into the fully closed position, when the door and the closing plane include a certain angle.

SUMMARY OF THE INVENTION

It is, therefore, an object of the present invention to provide an improved hinge of the above-described type and to obtain a further improved functioning of the closing mechanism in comparison with conventional hinges.

It is a further object of the invention to adapt the closing mechanism to be very compactly arranged in the hinge arm without impeding other parts of the hinge arm which are required for its mounting, e.g. fastening screws and adjusting screws for the adjustment of the joint and depth of the hinge.

It is a still further object of the invention to provide the hinge with a closing mechanism which is exchangeable. According to the invention, this is achieved by providing the shell jacket at its free end with at least one lateral driving pin resting against a supporting flange associated with a hinge link, the supporting flange defining a curved guiding surface for the closing pressure, and by disposing such supporting flange on a separate guiding block mountable on the hinge link.

An advantageous embodiment of the invention provides that the guiding block has a bore and a bolt or projection. In the mounted position the hinge axle on the side of the hinge arm extends through such bore, and the bolt engages in an aperture of the hinge link.

In such manner, the guiding block can be easily and solidly fastened to the hinge link.

The guiding block is preferably injection moulded of plastics material, whereby an exact guiding surface is obtained in a cost-saving manner.

The hinge link which carries no guiding faces or the like can be simply manufactured with wide tolerance ranges.

A further embodiment of the invention provides that the hinge link has two lateral flanges which receive the guiding block therebetween. Such two lateral flanges improve the fit of the guiding block on the hinge link.

A further embodiment of the invention provides that the shell is provided with a nose which is stopped at a holding face, when the hinge is open.

BRIEF DESCRIPTION OF THE DRAWINGS

The invention will now be described in more detail with reference to the accompanying drawings, by way of example only, and wherein.

DESCRIPTION OF THE PREFERRED EMBODIMENTS

Figure 1:
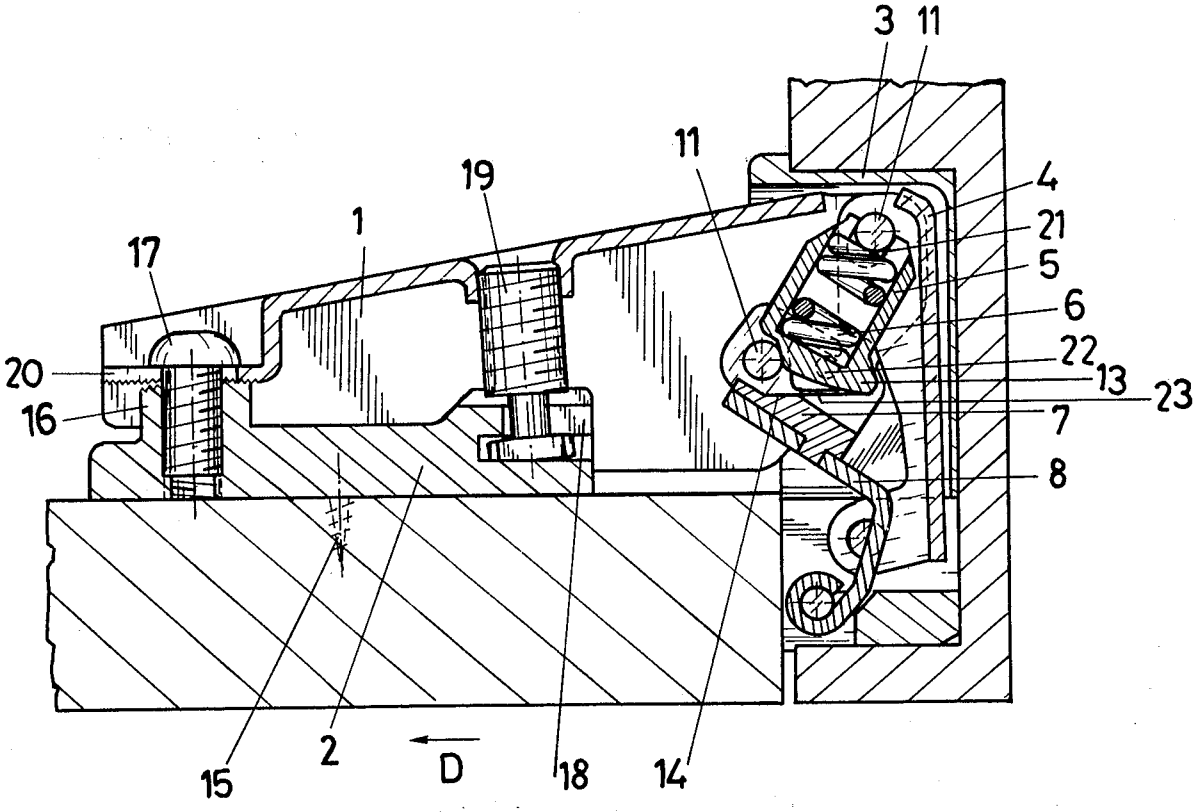
FIG. 1 is a sectional view of a hinge according to the invention in the closed position.
Figure 2:
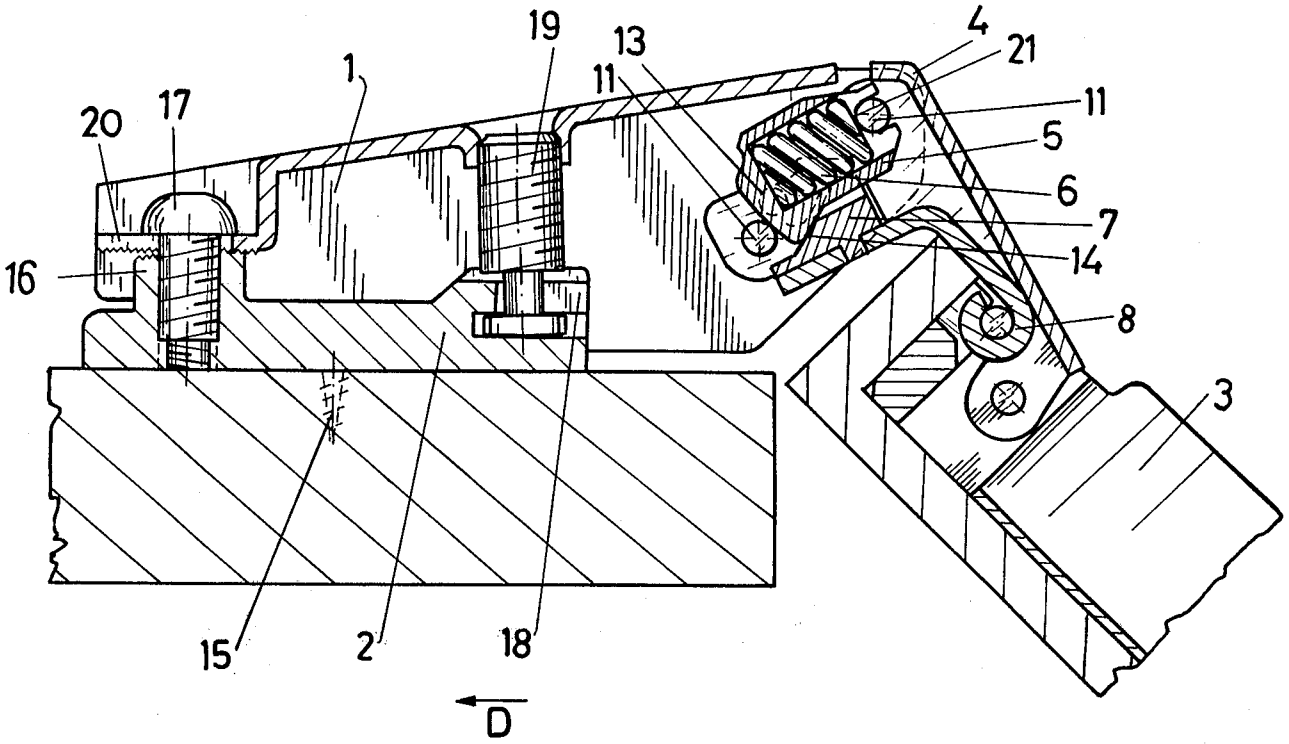
FIG. 2 is a sectional view of a hinge according to the invention in the open position.
Figure 3:
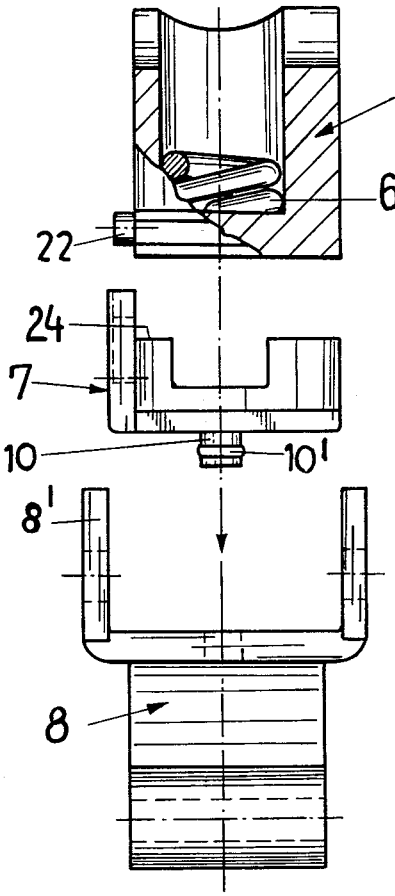
FIG. 3 is an exploded view showing the individual parts of the closing mechanism is disassembled position, parts thereof being in section.
Figure 4:
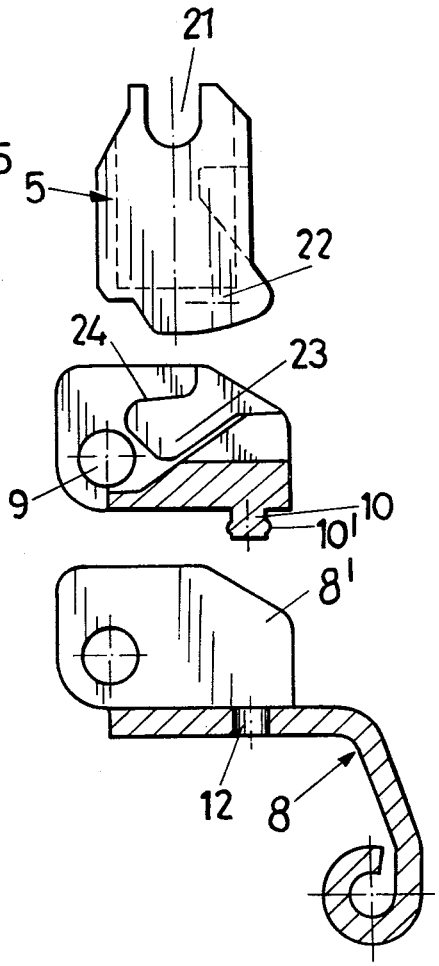
FIG. 4 is a view similar to FIG. 3, but turned by 90° relative thereto parts thereof also in section.
Figure 5:
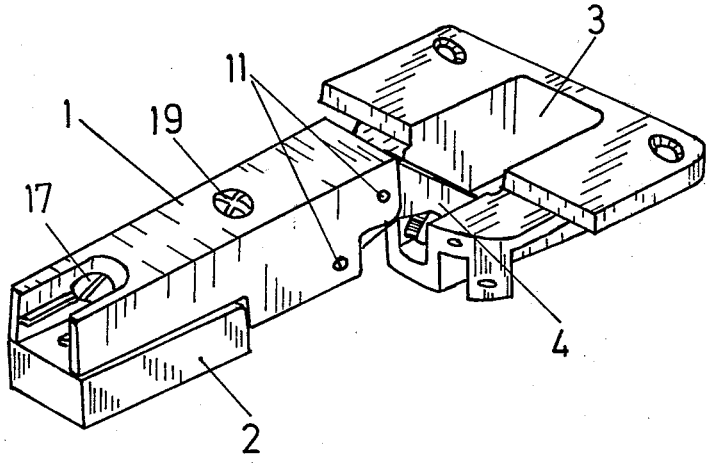
FIG. 5 is a perspective, three-dimensional view of the hinge according to the invention.

As can be seen in FIGS. 1 and 2, the hinge according to the invention substantially comprises a base plate 2 and a hinge arm 1. The hinge arm 1 is by means of hinge links 4, 8 connected with a dowel casing representing a hinge casing. The dowel casing 3 is insertable into a bore of a door, and the base plate 2 is fastenable to the other part of a piece of furniture, e.g. a side wall, by means of supporting screws 15.

In the rear region, the base plate 2 is provided with a base member 16 having an internal thread into which a fixing screw 17 is inserted. In the front region, the base plate 2 has projections 18 directed along its longitudinal center axis.

The hinge arm 1 is provided with a female thread into which an adjusting screw 19, for adjusting the joint and which is designed as a threaded bolt, is inserted. Further, the hinge arm 1 has at its end directed away from the bearings for the hinge axles a longitudinal slot 20 which is open on the rear side.

For mounting the door, the hinge arm 1 is disposed on the base plate 2 in such a manner that the head of the fixing screw 17 is positioned above the longitudinal slot 20. The hinge arm 1 is displaced in the direction of arrow D so that the annular projection or head of the joint adjusting screw 19 lies below the projections 18 of the base plate 2.

Hence, the hinge arm 1 is already anchored to the base plate 2, and the door is retained in position.

The dowel casing 3 and the hinge arm 1 are connected to each other by means of hinge links 4, 8, which are mounted on bearing axles 11 in the dowel casing 3 and on the hinge arm 1.

A sleeve or shell 5 is arranged between the two hinge links 4, 8 and the two hinge axles 11 of the hinge arm 1. The shell 5 is mounted on one hinge axle 11 by means of recesses 21, such one hinge axle 11 linking the hinge link 4 to the hinge arm 1.

A coil spring 6 is arranged in the shell 5, coil spring 6 resting against the inside of the shell 5 and against the one hinge axle 11.

A driving pin 22 extends laterally from the shell at an end thereof opposite the end having recesses 21.

Driving pin 22 extends into a recess 23 of a guiding block 7.

A supporting flange 24 of the guiding block 7 forms a curved guiding surface for a closing pressure, such curved guiding surface determining the angular position of the shell 5 in the hinge.

As can be seen in FIGS. 1 and 2, the pressure spring 6 exerts, when the hinge is closed, by means of the driving pin 22 and the guiding block 7 a torque on the hinge link 8 in the closing direction.

When the hinge is open, the hinge axles 11 and the driving pin 22 are positioned substantially in a straight line, as can be seen in FIG. 2, so that no torque is exerted on any of the hinge links 4, 8.

The door can, therefore, be freely moved without having to overcome the force of the spring 6.

The shell 5 is further provided with a nose 13, which rests against a holding or guiding face 14 of the guiding block 7, when the hinge is open, thereby guiding movement of shell 5 during opening and closing movements of the door and the hinge links.

The guiding block 7 is provided with a bore 9 and a bolt or projection 10.

In the mounted position, the bore 9 receives the hinge axle 11 linking the hinge link 8 to the hinge arm 1. The bolt 10 is inserted into an opening 12 in the hinge link 8 and retained therein by means of an annular enlargement 10'.

In the region of the guiding block 7, the hinge link 8 is provided with lateral flanges 8' which improve the fit of the guiding block 7 and prevent the guiding block from being deformed by forces acting thereupon, particularly when the guiding block is made of soft plastics material.

What is claimed is:

1. A hinge comprising:

a hinge arm adapted to be mounted on an article of furniture, said hinge arm including a pair of hinge axles;

a hinge casing adapted to be mounted on a door of the article of furniture, said hinge casing including a pair of hinge axles;

a pair of hinge links pivotally mounted to said hinge axles of said hinge arm and to said hinge axles of said hinge casing and therewith forming a quadrangular link mechanism mounting said hinge casing and the door to be pivotable with respect to said hinge arm and the article of furniture between open and closed positions of said hinge casing and the door;

an intermediate member in the form of a shell mounted about a first end thereof for pivotal movement;

a separate guiding block mounted on one of said hinge links at a fixed position with respect thereto;

pressure spring means, mounted within said shell, for urging a second end of said shell in directions primarily to abut with said guiding block when said hinge casing is in said closed position, thereby to urge said one hinge link in a closing direction, and primarily to abut one said hinge axle of said one hinge link when said hinge casing is in said open position; and said guiding block having guiding face means for guiding movement of said shell during opening and closing movements of said hinge links and said hinge casing.

2. A hinge as claimed in claim 1, wherein said shell has extending therefrom, adjacent said second end thereof, a lateral pin contacting a curved guiding surface provided on a supporting flange of said guiding block.

3. A hinge as claimed in claim 1, wherein said one hinge axle of said one hinge link connects said one hinge link to said hinge arm, and said first end of said shell is pivotally mounted about the said hinge axle connecting the other said hinge link to said hinge arm.

4. A hinge as claimed in claim 1, wherein said guiding block further includes a bore and a projection, said one hinge axle of said one hinge link extending through said bore, and said projection tightly fitting into an opening in said one hinge link.

5. A hinge as claimed in claim 4, wherein said one hinge link has two lateral flanges receiving said guiding block.

6. A hinge as claimed in claim 1, wherein said shell includes a projecting nose portion bearing against said guiding face of said guiding block.

7. A hinge as claimed in claim 1, wherein said guiding face of said guiding block is planar.

* * * * *